US008491401B2

(12) United States Patent
Szymanski

(10) Patent No.: US 8,491,401 B2
(45) Date of Patent: Jul. 23, 2013

(54) INFANT SWING WITH SEAT LOCKING MECHANISM

(75) Inventor: Matthew Alan Szymanski, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 265 days.

(21) Appl. No.: 13/038,716

(22) Filed: Mar. 2, 2011

(65) Prior Publication Data

US 2011/0230271 A1 Sep. 22, 2011

Related U.S. Application Data

(60) Provisional application No. 61/314,868, filed on Mar. 17, 2010.

(51) Int. Cl.
*A63G 9/12* (2006.01)
*A47C 3/03* (2006.01)

(52) U.S. Cl.
USPC ..... 472/118; 472/119; 297/270.1

(58) Field of Classification Search
USPC ..... 472/118–125; 297/270.1, 270.2, 297/DIG. 11
See application file for complete search history.

(56) References Cited

U.S. PATENT DOCUMENTS

| | | | | |
|---|---|---|---|---|
| 3,758,149 | A | 9/1973 | Emold | |
| 4,697,845 | A | 10/1987 | Kamman | |
| 4,911,499 | A | 3/1990 | Meeker | |
| 5,003,651 | A | 4/1991 | Rosen | |
| 5,364,137 | A | 11/1994 | Shimer | |
| 5,533,936 | A * | 7/1996 | Julien et al. | 472/118 |
| 5,617,594 | A | 4/1997 | Chien | |
| 5,863,097 | A | 1/1999 | Harper et al. | |
| 5,890,762 | A | 4/1999 | Yoshida | |
| 6,022,277 | A | 2/2000 | Jankowski | |
| 6,033,019 | A | 3/2000 | Hession-Kunz et al. | |
| 6,378,940 | B1 | 4/2002 | Longoria et al. | |
| 6,431,646 | B1 | 8/2002 | Longoria | |
| 6,511,123 | B1 | 1/2003 | Sitarski et al. | |
| 6,594,840 | B2 | 7/2003 | Tomas et al. | |
| 6,616,237 | B2 | 9/2003 | Sonner et al. | |
| 6,739,649 | B2 | 5/2004 | Kelly et al. | |
| 6,739,659 | B2 | 5/2004 | Dukes | |
| 6,739,660 | B2 | 5/2004 | Dukes | |
| 6,739,661 | B1 | 5/2004 | Dukes | |
| 6,811,217 | B2 | 11/2004 | Kane et al. | |
| 6,997,815 | B2 | 2/2006 | Devine | |
| 7,032,966 | B2 | 4/2006 | Myers | |
| 7,073,860 | B2 | 7/2006 | Markus | |
| 7,189,164 | B1 * | 3/2007 | Paesang et al. | 472/118 |
| 7,201,445 | B1 | 4/2007 | Dubiel et al. | |
| 7,329,192 | B2 | 2/2008 | Gibree | |

(Continued)

FOREIGN PATENT DOCUMENTS

| | | | |
|---|---|---|---|
| GB | 2375956 | A | 12/2002 |
| WO | 2005/096896 | A1 | 10/2005 |

*Primary Examiner* — Kien Nguyen
(74) *Attorney, Agent, or Firm* — Edell, Shapiro & Finnan, LLC

(57) ABSTRACT

An infant support structure includes a frame, a seat portion rotatably coupled to the frame so that the seat portion is movably coupled to the frame, an engagement member coupled to the seat portion, and a lock bar pivotally coupled to the lower portion of the frame, the lock bar movable between a first position disengaged from the engagement member thereby permitting swinging motion of the seat portion, and a second position engaging the engagement member and inhibiting swinging motion of the seat portion.

20 Claims, 7 Drawing Sheets

U.S. PATENT DOCUMENTS

| | | | | |
|---|---|---|---|---|
| 7,387,337 | B2 | 6/2008 | Keegan et al. | |
| 7,422,524 | B2 | 9/2008 | Gregorian | |
| 8,205,943 | B2 * | 6/2012 | Zhong | 297/274 |
| 2003/0025369 | A1 | 2/2003 | Maciejczyk | |
| 2003/0102702 | A1 | 6/2003 | Daley et al. | |
| 2005/0077765 | A1 | 4/2005 | Biaud | |
| 2007/0267904 | A1 | 11/2007 | Clapper et al. | |
| 2008/0061612 | A1 | 3/2008 | Crampton | |
| 2008/0111414 | A1 | 5/2008 | Sulzer | |

* cited by examiner

INFANT SWING WITH SEAT LOCKING MECHANISM

CROSS-REFERENCE TO RELATED APPLICATIONS

This application claims the benefit of and priority under 35 U.S.C. 119(e) to U.S. Provisional Application No. 61/314,868, entitled "INFANT SWING WITH SEAT LOCKING MECHANISM", filed Mar. 17, 2010, the disclosure of which is incorporated herein by reference in its entirety. This patent application is also related to U.S. Non-Provisional patent application Ser. No. 12/725,629, entitled "Power Source Compartment for an Infant Support Structure," filed Mar. 17, 2010, the entire disclosure of which is incorporated by reference herein.

FIELD OF THE INVENTION

The present invention relates to an infant swing and in particular, to an infant swing having a seat that can be locked in a predetermined position and be prevented from swinging.

BACKGROUND OF THE INVENTION

Conventional infant swings include a seat or seat portion that can be moved via a motor or drive mechanism or otherwise be freely swinging relative to a frame. In either case, there may be times when a caregiver may not want the seat of the swing to move back and forth.

There is therefore a need for an infant swing that includes a locking mechanism to prevent the seat of the swing from moving. In addition, there is a need for a locking mechanism for an infant swing that is easily useable and does not interfere with the movement of the seat when the locking mechanism is not in use.

SUMMARY OF THE INVENTION

In one embodiment, the present invention relates to an infant swing that includes a frame, a support arm movably coupled to the frame and a seat portion coupled to the support arm, the seat portion being movable relative to the frame. A locking mechanism is further provided and includes a first locking portion and a second locking portion, the first locking portion having a first end and a second end opposite to the first end, the first end being coupled to one of the seat portion or the frame, the second locking portion being coupled to the other of the seat portion or the frame, the first locking portion being movable between a first position in which the second end is disengaged from the second locking portion so that the seat portion can move relative to the frame, and a second position in which the second end is engaged with the second locking portion so that movement of the seat portion relative to the frame is prevented.

In one implementation, the first locking portion is pivotally coupled to the frame, the second locking portion is connected to and extends outward from the seat portion and the first locking portion slidably engages the second locking portion.

In a particular embodiment, the first locking portion is a lock bar that includes on a free end thereof a pair of resilient arms that are engageable with the second locking portion. The arms may include one or more lips or lip portions and the lips may include an indentation that engages with a ridge on the second locking portion.

In another embodiment, the second locking portion includes a first engagement member and a second engagement member, and each of the engagement members is coupled to the seat portion. The first locking portion is pivotally coupled to the frame and engageable with the engagement members. The seat portion is releasably locked in a first orientation when the first locking portion is engaged with the first engagement member, and the seat portion is releasably locked in a second orientation when the second locking portion is engaged with the second engagement member.

BRIEF DESCRIPTION OF THE DRAWINGS

Like reference numerals have been used to identify like elements throughout this disclosure.

DETAILED DESCRIPTION OF THE INVENTION

Figure 1:
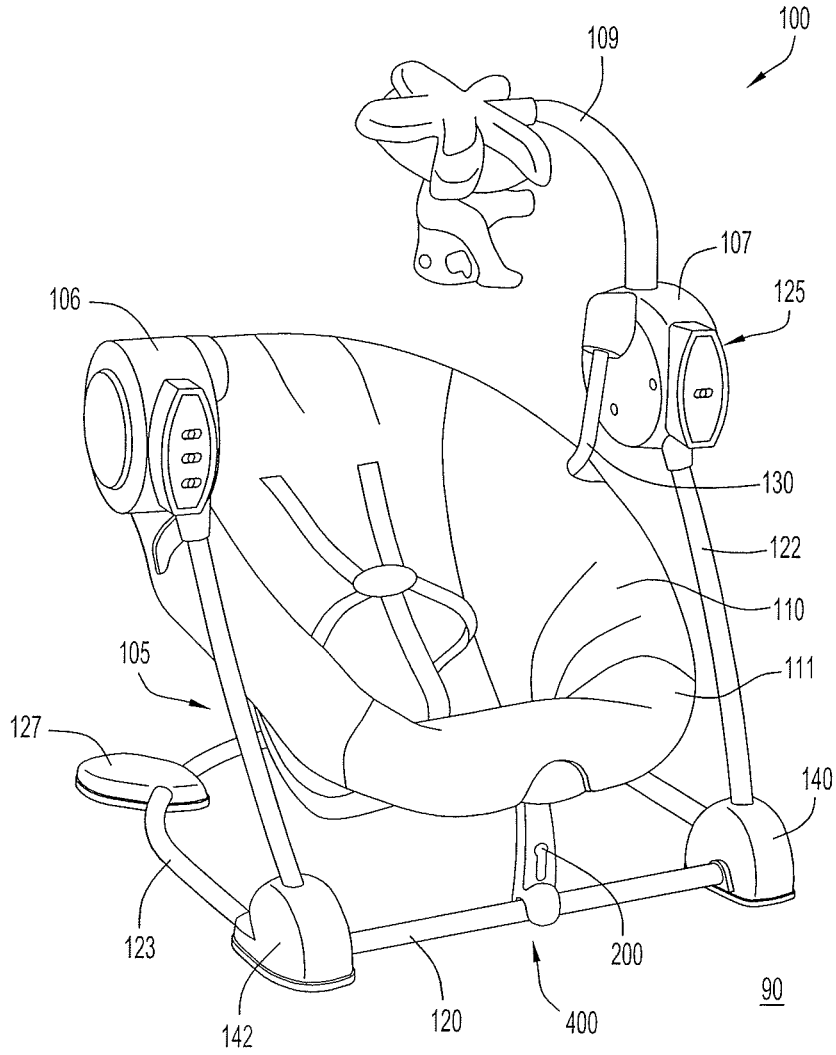
FIG. 1 is a perspective view of an embodiment of an infant swing according to the present invention.

Referring to FIG. 1, a perspective view of an infant swing 100 according to the present invention is illustrated. The infant swing 100 includes a frame 105 and a seat or seat portion 110 that is coupled to and supported by the frame 105. The frame 105 includes a pair of hubs 106 and 107 and a pair of swing or support bars or arms 130 and 132 (see FIG. 5) that are pivotally coupled to the hubs 107 and 106, respectively. A toy bar 109 with one or more hanging objects can be coupled to hub 107. The seat portion 110 includes softgoods 111 that are removably coupled to the seat bucket. In the following Figs., the softgoods 111 are removed from the bucket for ease of reference.

In this embodiment, support bar 130 is operatively connected to a motorized swinging mechanism or drive mechanism 125 that moves the support bar 130 forward and backward relative to the frame 105 such that a swinging motion is imparted to seat portion 110. An infant placed in seat portion 110 may, accordingly, be gently rocked in the seat portion 110. The drive mechanism 125 may be powered by a power source such as batteries or may be connected to an electrical power system.

In an alternative implementation, the drive mechanism 125 could be located in hub 106, rather than hub 107. Additionally, the drive mechanism 125 may be eliminated and replaced with an unpowered hinge mechanism (not shown) or shaft and bearing arrangement (also not shown) that allows for the seat to freely swing relative to the frame 105. A swinging motion can be imparted to the seat portion 110 in such an implementation by, for example, rocking the seat portion 110 by hand.

The frame 105 of the infant swing 100 includes a lower frame portion 120 and upper frame portion 122. The lower frame portion 120 may rest on the ground or floor or support surface 90 and the upper frame potion 122 may be connected to lower frame portion 120 via connectors 140 and 142. In one embodiment, the lower frame portion 120 may be disengaged or disconnected from connectors 140 and 142 so that the infant swing 100 can be more easily transported. In an alternate embodiment, the loop portion 123 may be disengaged or disconnected from connectors 140 and 142 so that the infant swing 100 can be more easily transported.

In the illustrated embodiment, the lower portion 120 includes a front bar portion 121 and a loop portion 123 with at least one foot member 127 coupled thereto. The foot member 127 can be configured to engage a support surface. In different embodiments, the shape of the components of the lower portion 120 can vary.

While infant swings are designed to move backwards and forwards and impart movement to the seat portion 110, it may sometimes be desirable to stop the seat portion 110 from swinging. Embodiments of the present invention provide a locking mechanism for an infant swing. More specifically, a locking mechanism 400, components of which are shown in FIGS. 1-6, is provided on an underside of seat portion 110 and on lower frame 120. The location of the locking mechanism 400 in the front area of the swing 100 facilitates the access and manipulation of the locking mechanism 400 by a parent or caregiver.

One component of locking mechanism 400 is a locking arm or lock bar 200, which is shown in more detail in FIGS. 1-4. Lock bar 200 includes a first end 202, a second end 204 opposite to the first end 202, and a body 206. The first end 202 is pivotally connected via a connector 208, such as a screw or rivet, at pivot point 209 to lower frame portion 120. The second end 204 is not coupled to the frame 105 and along with the body 206, the second end 204 is free to move in an arcuate path relative to point 209, as shown by directions of arrow "A" in FIG. 3.

Lock bar 200 may be made of molded plastic or any other material that can be shaped to provide the functionality described herein. In addition, the length of the lock bar 200 may vary in different embodiments.

Figure 2:
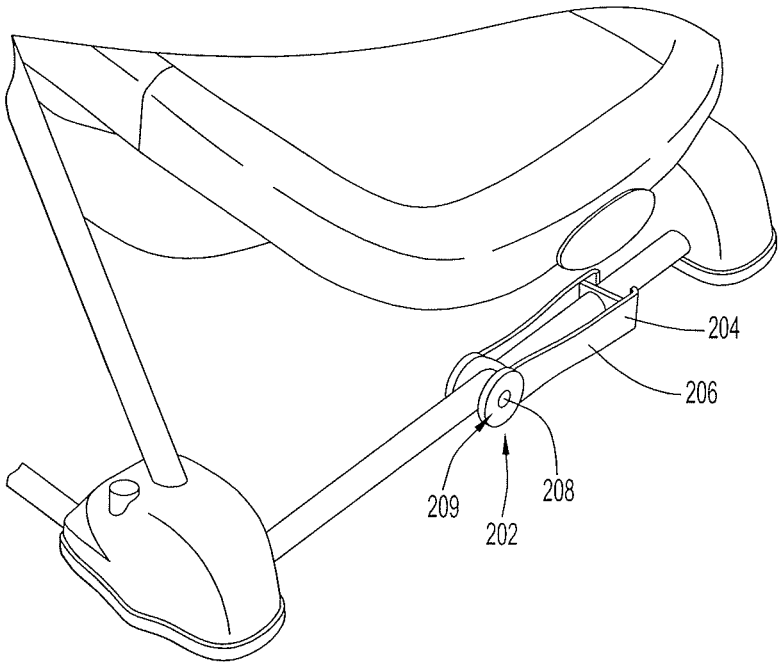
FIG. 2 is perspective view of a lock bar used to lock the seat of the infant swing illustrated in FIG. 1 in a predetermined position according to the present invention.

Referring to FIG. 2, the lock bar 200 is illustrated in a first position or stowed position in which the locking mechanism 400 is in a released configuration and is not deployed. As discussed greater detail below, the lock bar 200 is placed in contact with or engaged with a portion of the frame 105 when the lock bar 200 is in its non-use position. In this position, the lock bar 200 is not in the way of the seat portion 110 as it swings back and forth. Also, in this position, the lock bar 200 is less likely to be engaged by the seat 110 or a person and broken by such engagement. The engagement of the lock bar 200 with the lower frame portion 120 results in a secure position for the lock bar 200, as described below.

Figure 3:
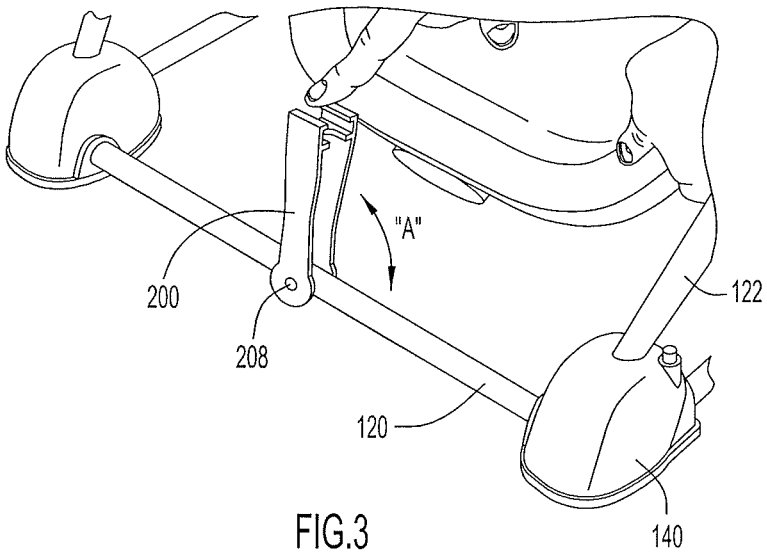
FIG. 3 is a perspective view of the lock bar illustrated in FIG. 2 in a position for locking the seat of the infant swing according to the invention.

Referring to FIG. 3, the lock bar 200 is illustrated in a second position or engaged position. When the lock bar 200 is in this position, the locking mechanism 400 is in a deployed or use configuration. In this embodiment, the lock bar 200 is substantially vertically oriented and in a position to engage an underside of seat portion 110. As described in greater detail below, when the lock bar 200 is in its second position, the seat 110 is locked in place with respect to lower frame 120 and, consequently, the seat 110 is prevented from swinging.

When the bar 200 is not used to lock the seat 110 relative to the frame 105, the bar 200 can be placed in a stowed position as shown in FIG. 2. The stowed position results in a reduced or low profile for the bar 200, thereby reducing the likelihood that the bar will interfere with the swinging of the seat 110 or be broken. In this embodiment, bar 200 includes a channel 250 that has a plate portion 234 with a curved or arcuate surface 235 having a curvature and radius that substantially matches a curvature and radius of the lower frame portion 120. In alternative embodiments, the lower frame portion may not be curved and have a radius and may have any type of cross-sectional shape. The channel 250 is sized so that the lower frame portion 120 is received in the channel 250.

In an alternative embodiment, the bar 200 may include two channels 250 formed on opposite sides of the body 206 from each other. The channels 250 are similarly configured such that either channel 250 can receive part of the lower frame portion 120, depending on the direction in which the bar 200 is rotated. Such a configuration would allow the bar 200 to placed in contact with and substantially parallel to the lower frame portion 120 in opposite directions relative to point 209.

The plate portion 234 near the second end 204 of lock bar 200 includes a pair of protrusions 255 (only one of which is visible in FIG. 4) that defines a receptacle 256 therebetween. The protrusions 255 are separated by a distance slightly less than a diameter of lower frame portion 120. Thus, when the second end 204 of lock bar 200 is pressed against lower frame portion 120, the second end 204 is snapped in place and retained due to friction between the parts. In other words, lower frame portion 120 is captured by protrusions 255 when the bar 200 is in its lowered position. The bar 200 can be subsequently can be released or decoupled from lower frame portion 120 by a user pulling the second end 204 of lock bar 200 away from lower frame portion 120 with sufficient force.

Figure 4:
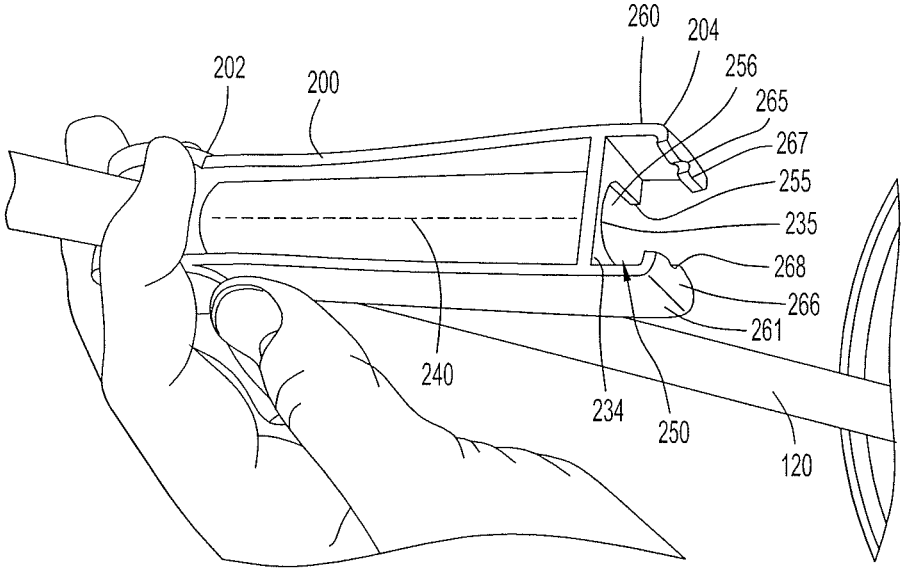
FIG. 4 is detailed perspective view of one end of the lock bar illustrated in FIG. 2 according to the invention.

Also shown in detail in FIG. 4 are additional aspects of the lock bar 200. The second end 204 of bar 200 includes a pair of opposing arms 260 and 261 that have a lips or lip portions 265 and 266, respectively, that extend inwardly and toward a longitudinal axis 240 of lock bar 200. The lip potions 265 and 266 include indentations 267 and 268, respectively, that, as will be explained, are used to snap or anchor the second end 204 of lock bar 200 to an engagement component 600 on an underside of infant seat 110 (see FIGS. 5 and 6).

Figure 5:
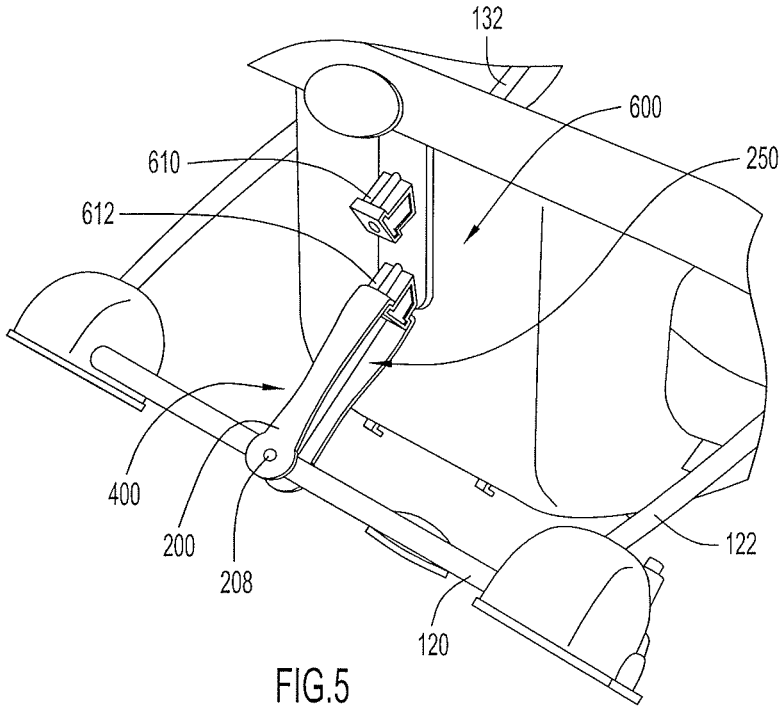
FIG. 5 is a bottom perspective view of the infant swing illustrated in FIG. 1 showing the locking portion in a deployed configuration according to the invention.

Referring now to FIG. 5, the locking mechanism 400 in use is shown. In addition to lock bar 200, the locking mechanism 400 includes an engagement component 600 located on the seat 110. The lock bar 200 is a movable component that is movably coupled to the frame 105 and selectively engageable or securable to the lower frame portion 120 and to the engagement component 600, as described below.

In this embodiment, the engagement component 600 includes blocks 610 and 612. The blocks 610 and 612 can be referred to alternatively as locking blocks. As illustrated in FIG. 5, the second end 204 of lock bar 200 is engaged with block 612 in this position. This engagement locks the seat portion 110 in a predetermined position with respect to lower frame portion 120 and the frame 105 as a whole. If the second end 204 of the bar 200 is engaged with block 610 instead of block 612, the seat portion 110 is locked in another predetermined position with respect to the frame 105. The two predetermined positions enable seat portion 110 to thus be set and maintained at different angles with respect to the floor 90 and the frame 105. Thus, a parent or caregiver can chose an angle at which the infant and seat portion 110 is to be held and couples the lock bar 200 and the particular block 610 or 612 of the locking mechanism 400 together.

Figure 6:
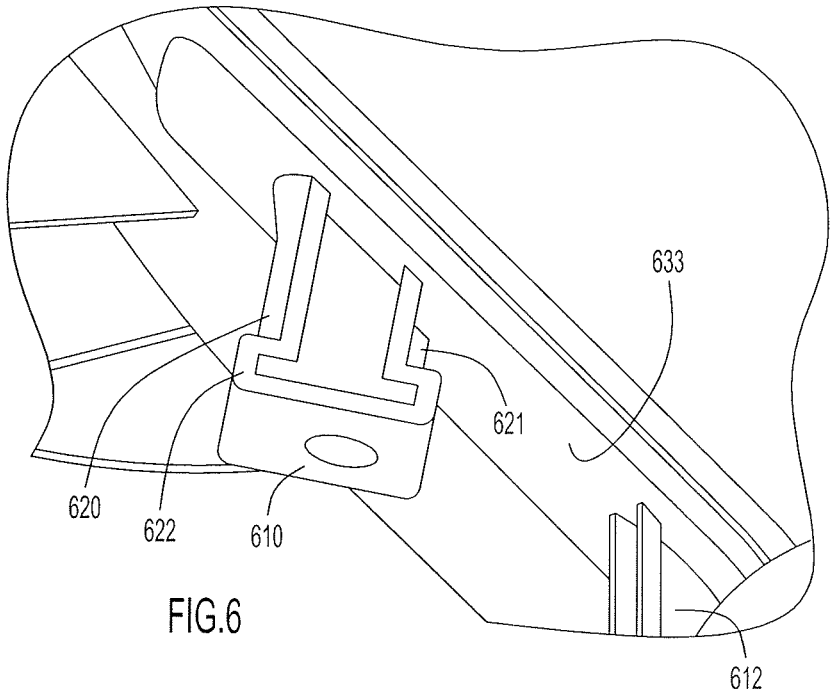
FIG. 6 is a detailed perspective view of an engagement portion or locking block on an underside of a seat of the infant swing illustrated in FIG. 1 according to the invention.

FIG. 6 is a detailed view of an engagement portion or locking block 610. Note that block 612 may be similarly configured to block 610. In one embodiment, blocks 610 and 612 may be integrally formed or molded with seat portion 110. In an alternative embodiment, blocks 610 and 612 may be secured to the underside of the seat portion 110 via screws or other attachment or coupling techniques or mechanisms. In one embodiment, the blocks 610 and 612 can be integrally formed with a plate 633 that is coupled to the lower surface or side of the seat portion 110. The plate 633 can be snapped to the seat portion 110, such as being inserted into an opening in the bottom of the seat portion 110, or otherwise secured thereto by connectors, such as screws. The location of a component of the locking mechanism 400 on the underside or lower surface of the seat 110 eliminates the risk of a child, a parent or caregiver, or an object getting caught on the locking mechanism 400 component and interfering with the motion of the seat 110.

Locking block 610 extends downward from the underside of seat portion 110 and includes a head portion 622 at a distal end thereof. Head portion 622 has a shape that is configured to fit within a space bounded between arms 260 and 261 on bar 200. In addition, the head portion 622 is configured to fit between the plate 234 and the lips 265 and 266 on opposite sides of the second end 204 of lock bar 200.

Locking block 610 may also include a coupling mechanism including a pair of ridges 620 and 621 that engage with a corresponding coupling mechanism including indentations 267 and 268, respectively, when the second end 204 of lock bar 200 slides into and fully engages with block 610 or block 612. The engagement or coupling between ridges 620 and 261 and indentations 267 and 268 ensures that the second end 204 of lock bar 200 is properly engaged with the particular block 610 or 612. The coupling mechanisms on the block 610 or 612 and the bar 200 cooperate to enhance the engagement of the locking mechanism 400 in its locked configuration.

Resilient material such as plastic may be used to allow arms 260 and 261 to spread apart slightly to permit the ridges 620 and 621 to pass into the space between the arms 260 and 261 and then snap into place in indentations 267 and 268. In an alternative embodiment, the bar 200 may include a single indentation and the block 610 or 612 may include a single ridge.

Figure 7:
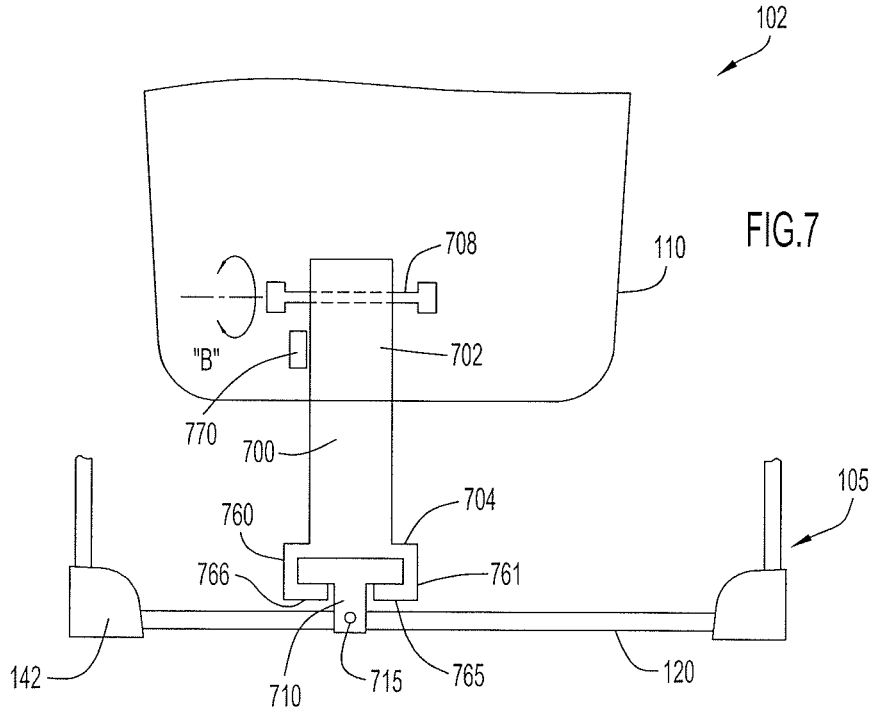
FIG. 7 is a perspective view of an alternative embodiment of an infant swing according to the invention.
Figure 8:
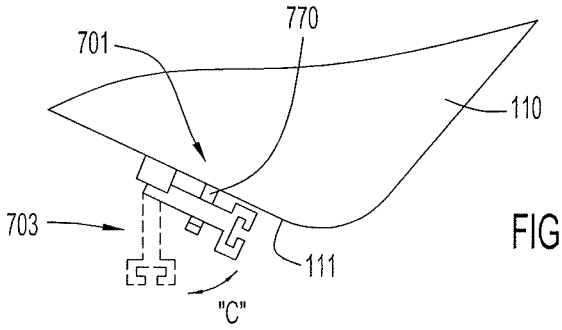
FIG. 8 is a side view of a portion of the infant swing illustrated in FIG. 7.

Referring to FIGS. 7 and 8, an alternative embodiment of an infant swing according to the invention is illustrated. In this embodiment, the infant swing 102 includes a seat portion 110 that is pivotally supported by a frame 105, only a portion of which is illustrated for ease of reference. The infant swing 102 includes a locking mechanism 700 that has a lock bar 700 and a locking block 710. The lock bar 700 has a similar configuration to the lock bar 200 previously described and includes a coupled end 702 and a free end 704. In this embodiment, the lock bar 700 is pivotally coupled to seat portion 110 via pivot 708 which extends through an opening in the bar 700. The free end 704 of the lock bar 700 includes opposing arms 760 and 761 with lips 765 and 766 similar to arms 260 and 261 of bar 200.

The lower surface 111 of the seat 110 may include an engagement structure 770 that is used to retain the bar 700 in a retracted or stowed position 701 in which the bar 700 extends along a portion of the seat 110 and does not interfere with the swinging motion of the seat 110. When released from the engagement structure 770, which may be a resilient finger with a tab, the bar 700 can move to its deployed or locked position 703 along the direction of arrow "C."

In this embodiment, a locking block 710 is coupled to the lower frame portion 120 via one or more connectors 715, such as screws or rivets, or other conventional connection mechanism or technique. To secure the seat 110 in a position relative to the frame 105, end 704 is brought into engagement with the block 710 and the arms 760 and 761 engage the block 710 to maintain the seat 110 relative to the frame 105. In one embodiment, the locking block 710 can be fixedly coupled to the lower frame portion 120. In an alternative embodiment, the locking block 710 can be pivotally coupled to the lower frame portion 120.

Although lock bar 200 in FIG. 7 is shown to pivot in a direction shown by arrow B (i.e., forward and backward, like seat portion 110), lock bar 200 could also be configured to pivot side to side by re-orienting pivot 708 by approximately 90 degrees.

Referring to FIGS. 9-9B, 10, and 11, an alternative embodiment of a swing is illustrated. In this embodiment, similar to swing 100, swing 900 includes a frame 105 and a seat portion 110 movably coupled to the frame 105, which has a lower frame portion 120. The swing 900 includes a locking mechanism 1000 that can be used to prevent the movement of the seat 100 relative to the frame 105.

Figure 9:
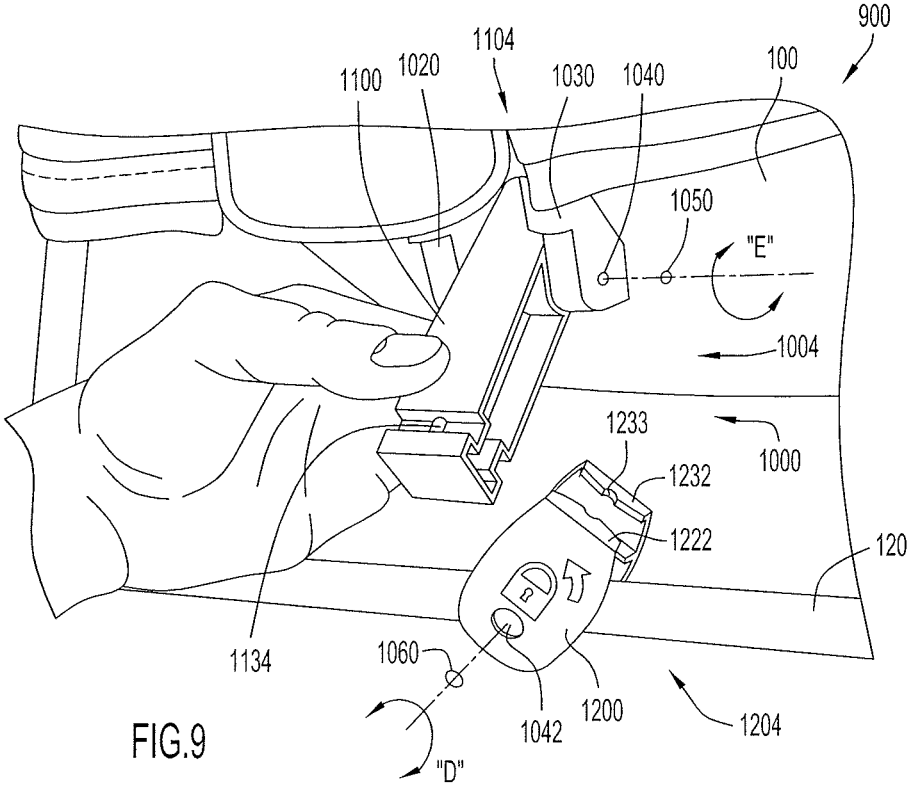
FIG. 9 is a front view of an alternative embodiment of a locking mechanism according to the invention in an unlocked configuration.

Referring to FIG. 9, the locking mechanism 1000 includes a locking member 1100 that is pivotally coupled to the seat 100 and a locking member 1200 that is pivotally coupled to the lower support member 120 of the frame 105. In particular, locking member 1100 is located in a space 1032 (see FIG. 10) between mounts 1020 and 1030 and is pivotally coupled to mounts 1020 and 1030 by a connector 1040. The connector 1040 defines an axis 1050 about which the locking member 1100 relates along the directions of arrow "E." The locking member 1100 is illustrated in a released position 1104 in FIG. 9.

Locking member 1200 is pivotally coupled to the member 120 via a connector 1042 that defines an axis 1060 about which the locking member 120 pivots along the directions of arrow "D." Locking member 1200 is illustrated in a released position 1204 in FIG. 9. The locking mechanism 1000 is in a released configuration 1004 when the locking members 1100 and 1200 in their released positions 1104 and 1204. In these positions, the locking members 1100 and 1200 are not engaged with each other. As a result, the seat 100 can swing relative to the frame 105.

Figure 9A:
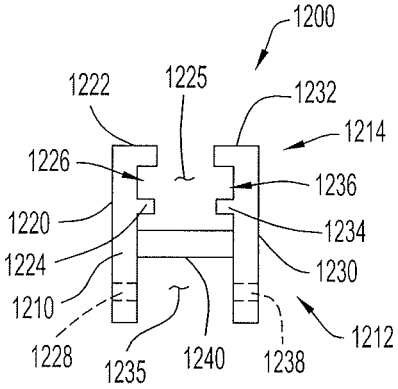
FIG. 9A is a side view of a locking member of the locking mechanism illustrated in FIG. 9.

An embodiment of locking member 1200 is illustrated in FIG. 9A. In this embodiment, locking member 1200 is a molded plastic object that includes a body 1210 with side portions 1220 and 1230. The body 1210 includes a mounting portion 1212 that is mounted to the lower support member 120 and a coupling portion 1214 that can be coupled to locking member 1100.

The body 1210 includes a cross member 1240 that is coupled to the side portions 1220 and 1230. The cross member 1240 does not extend the full width of the side portions 1220 and 1230. As shown, side portion 1220 includes a lip 1222 and a ridge 1224 that define a groove 1226 therebetween. The lower end of the side portion 1220 includes an opening or hole 1228 through which the connector 1042 is inserted. Similarly, side portion 1230 includes a lip 1232 and a ridge 1234 that define a groove 1236 therebetween. The lower end of side portion 1230 includes an opening or hole 1238 though which the connector is inserted after passing through a hole (not shown) in the lower support member 120.

Figure 9B:
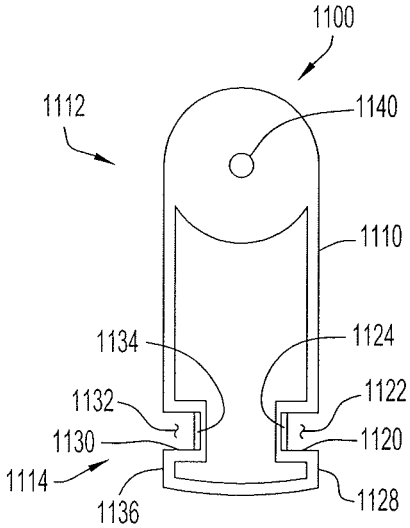
FIG. 9B is a side view of another locking member of the locking mechanism illustrated in FIG. 9.

An embodiment of locking member 1100 is illustrated in FIG. 9B. In this embodiment, locking member 1100 is a molded plastic object that includes a body 1110 having a mounting portion 1112 that is coupled to the seat 100 and a coupling portion 1114 that can be coupled to locking member 1200. The mounting portion 1112 includes an opening 1140 through which connector 1050 extends to mount the locking member 1100 to the seat 100 and in particular, to the mounts 1020 and 1030.

The coupling portion 1114 includes an edge 1130 that defines a recess or groove 1132 that receives the lip 1222 of locking member 1200 when the locking members 1100 and 1200 are pivoted into engagement with each other. A ridge 1134 is formed that extends into the recess 1132. On the opposite side, the coupling portion 1114 also includes an edge 1120 that defines a recess or groove 1122 that receives the lip 1232 of locking member 1200. As shown in FIG. 9, the lip 1232 includes a notch 1233 that receives the ridge 1124 on locking member 1100 to provide a positive engagement between the locking members 1100 and 1200 to hold them together.

When locking member 1200 is pivoted about axis 1060 and engaged with locking member 1100, the projecting portions 1128 and 1136 of locking member 1100 are inserted into and slid along the grooves 1226 and 1236, respectively. When the ridges 1134 and 1124 of locking member 1100 engage the notches (only notch 1233 shown) of lips 1222 and 1232, respectively, a positive engagement of the locking members 1100 and 1200 is achieved. The positive engagement can be overcome by a user moving locking member 1200 about axis 1060 into engagement with locking member 1100.

Figure 10:
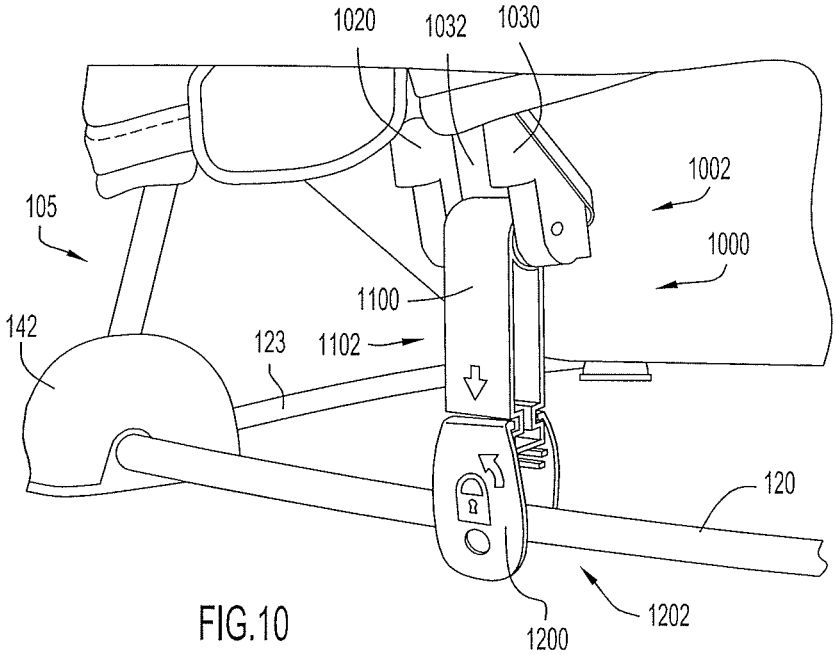
FIG. 10 is a front view of the locking mechanism illustrated in FIG. 9 in a locked configuration.

The locking mechanism 1000 is illustrated in FIG. 10 in its locked configuration 1002. In this configuration 1002, the locking members 1100 and 1200 are engaged with each other, thereby prevent movement of the seat 100 relative to the frame 105. To reach this configuration 102, locking member 1100 is pivoted to its locking position 1102. Then, locking member 1200 is pivoted into engagement with locking member 1200 by moving to its locking position 1202.

Figure 11:
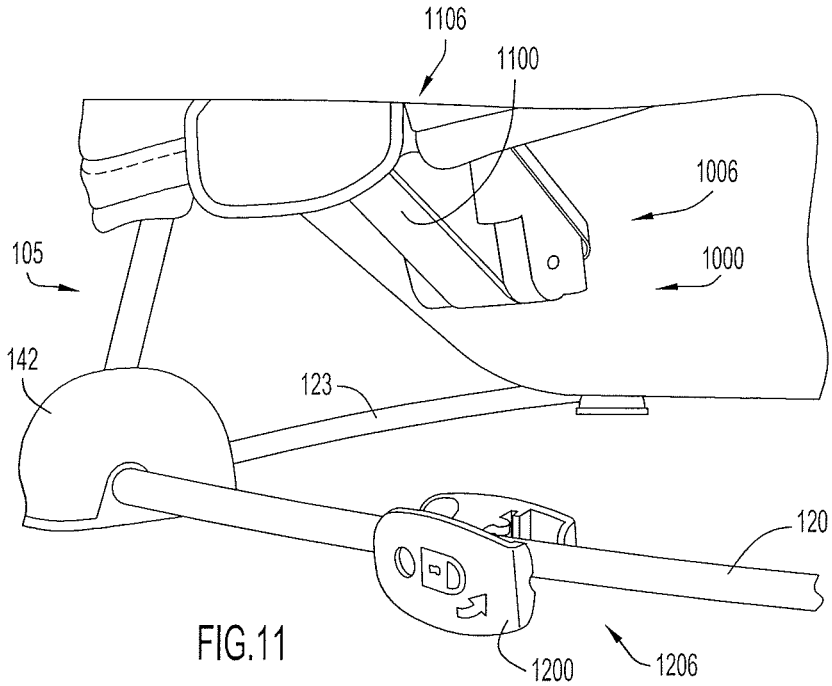
FIG. 11 is a front view of the locking mechanism illustrated in FIG. 9 in a stored configuration.

Referring to FIG. 11, the locking mechanism 1000 is illustrated in its stored configuration 1006. In this configuration 1006, locking member 1200 is pivoted to a stored or retracted position 1206 in which the lower support member 120 is located in the space between the side portions 1220 and 1230. This stored position prevents contact of the locking member 1200 by the seat 100 or other component of the swing. Locking member 1100 is moved or pivoted to its stored or retracted position 1106 as well. In this position 1106, the likelihood of the locking member 1100 being engaged or contacted by locking member 1200 or other component of the swing is reduced. Thus, the seat 100 can swing freely relative to the frame. In this position, locking member 1100 is located in part in the space 1032 between mounts 1020 and 1030.

Thus, embodiments described herein provide an infant swing that includes a frame, a support or swing arm, and a seat portion. The infant swing includes a locking mechanism that can be used to lock the seat portion in a predetermined position relative to the frame. The locking mechanism includes a pivotally mounted lock bar that is engageable with a locking block on an underside of the seat portion or connected to the frame of the infant swing.

Other embodiments of the invention are possible and should be considered to be within the scope and spirit of the invention. For instance, the second end of lock bar could instead be configured to include the features of the locking block, and the locking block could be configured to have the arms and lips of the lock bar depicted in the drawings. The components could engage with another in the same way described herein. Still other embodiments and implementations are possible.

It is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration.

What is claimed is:

1. An infant swing, comprising:

a frame;

a support arm movably coupled to the frame;

a seat portion coupled to the support arm, the seat portion being movable relative to the frame; and a locking mechanism including a first locking portion and a second locking portion, the first locking portion having a first end and a second end opposite to the first end, the first end being coupled to one of the seat portion or the frame, the second locking portion being coupled to the other of the seat portion or the frame, the first locking portion being movable between a first position in which the second end is disengaged from the second locking portion so that the seat portion can move relative to the frame, and a second position in which the second end is engaged with the second locking portion so that movement of the seat portion relative to the frame is prevented.

2. The infant swing of claim 1, wherein the first locking portion is pivotally coupled to the frame and movable between the first position and the second position.

3. The infant swing of claim 1, wherein the second locking portion is connected to and extends outward from the seat portion.

4. The infant swing of claim 1, wherein the frame has a lower portion and an upper portion, the support arm is rotatably coupled to the upper portion of the frame, the first locking portion is pivotally coupled to the frame, and the second locking portion is coupled to seat portion.

5. The infant swing of claim 1, wherein the first locking portion slidably engages the second locking portion.

6. The infant swing of claim 1, wherein the first locking portion includes a locking arm with a first end and a second end, the first end of the locking arm being pivotally coupled to the frame and the second end of the locking arm being selectively engageable with the second locking portion.

7. The infant swing of claim 6, wherein the second end of the locking arm includes a pair of resilient arms that are engageable with the second locking portion.

8. The infant swing of claim 6, wherein the locking arm is configured to be placed in a stowed position by engaging the second end of the locking arm with the frame.

9. The infant swing of claim 6, wherein the second locking portion includes a ridge, and the second end of the locking arm includes an indentation that receives the ridge when the locking arm is engaged with the second locking portion.

10. The infant swing of claim 1, wherein the second locking portion includes a first engagement member and a second engagement member, each of the engagement members being coupled to the seat portion, the first locking portion being pivotally coupled to the frame and engageable with the engagement members, the seat portion releasably locked in a first orientation when the first locking portion is engaged with the first engagement member, and the seat portion releasably locked in a second orientation when the second locking portion is engaged with the second engagement member.

11. An infant support structure, comprising:

a frame having a lower portion and an upper portion;

a seat portion rotatably coupled to the upper portion of the frame so that the seat portion is movably coupled to the frame;

an engagement member coupled to the seat portion; and a lock bar pivotally coupled to the lower portion of the frame, the lock bar movable between a first position disengaged from the engagement member thereby permitting swinging motion of the seat portion, and a second position engaging the engagement member and inhibiting swinging motion of the seat portion.

12. The infant support structure of claim 11, wherein the engagement member is coupled to an underside of the seat portion.

13. The infant support structure of claim 11, wherein the engagement member is a first engagement member, the seat portion includes a second engagement member, the seat portion being releasably locked in a first orientation when the lock bar is engaged with the first engagement member, and the seat portion being releasably locked in a second orientation when the lock bar is engaged with the second engagement member.

14. The infant support structure of claim 11, wherein the lock bar is releasably stowed against the frame.

15. The infant support structure of claim 11, wherein the lock bar comprises arms configured to engage the engagement member.

16. An infant support structure comprising:

a support frame;

a swing arm movably coupled to the frame;

a seat portion coupled to the swing arm;

an engagement portion disposed on one of the seat portion or the support frame; and a lock bar coupled to the other of the seat portion or the frame, the lock bar being movable between a first position in which the engagement portion receives part of the lock bar and a second portion in which the lock bar is disengaged from the engagement portion, the seat portion being maintained in a fixed position relative to the support frame when the lock bar is in its first position, and the seat portion being movable relative to the support frame when the lock bar is in its second position.

17. The infant support structure of claim 16, wherein the lock bar is pivotally coupled to the support frame and the engagement portion is fixed to the seat portion.

18. The infant support structure of claim 17, wherein the engagement portion slidably receives the lock bar.

19. The infant support structure of claim 16, wherein the lock bar comprises arms that contact the engagement portion when the lock bar is in the first position.

20. The infant support structure of claim 16, wherein the lock bar has a free end that includes a coupling mechanism that captures the support frame.

* * * * *